US011392061B2

(12) United States Patent
Okuyama

(10) Patent No.: US 11,392,061 B2
(45) Date of Patent: Jul. 19, 2022

(54) DEVELOPING APPARATUS CAPABLE OF ENHANCING EFFICIENCY OF PEELING OFF DEVELOPER FROM A DEVELOPING SLEEVE

(71) Applicant: CANON KABUSHIKI KAISHA, Tokyo (JP)

(72) Inventor: Yuta Okuyama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/409,141

(22) Filed: Aug. 23, 2021

(65) Prior Publication Data

US 2022/0066356 A1 Mar. 3, 2022

(30) Foreign Application Priority Data

Aug. 25, 2020 (JP) ..... JP2020-142113
Jun. 11, 2021 (JP) ..... JP2021-097957

(51) Int. Cl.
*G03G 15/09* (2006.01)

(52) U.S. Cl.
CPC ..... *G03G 15/0928* (2013.01); *G03G 15/0921* (2013.01)

(58) Field of Classification Search
CPC . G03G 15/09; G03G 15/0921; G03G 15/0928
USPC ..... 399/267, 272–277
See application file for complete search history.

(56) References Cited

U.S. PATENT DOCUMENTS 6,421,520 B2 * 7/2002 Masuda et al. .... G03G 15/0921 399/277
10,705,452 B2 * 7/2020 Shigehiro ..... G03G 15/0921

FOREIGN PATENT DOCUMENTS

JP 2001194911 A 7/2001
JP 2002148921 A 5/2002
JP 2002151324 A 5/2002
JP 2017191220 A 10/2017

* cited by examiner

*Primary Examiner* — William J Royer
(74) *Attorney, Agent, or Firm* — Canon U.S.A., Inc. I.P. Division

(57) ABSTRACT

In a developing apparatus, a distance along an outer peripheral surface of a rotatable developing member between a first and a second maximum peak positions is less than 18 [mm], the first and the second maximum peak positions respectively corresponding to maximum values of a magnetic flux density of a first and a second magnetic poles with respect to a normal direction of the rotatable developing member. A distance along the outer peripheral surface of the rotatable developing member in a width of a value obtained by adding 2 [mT] to a minimum value of the magnetic flux density with respect to the normal direction of the rotatable developing member is 5.5 [mm] or more, at a downstream side of the first maximum peak position and at an upstream side of the second maximum peak position with respect to a rotation direction of the rotatable developing member.

13 Claims, 6 Drawing Sheets

DEVELOPING APPARATUS CAPABLE OF ENHANCING EFFICIENCY OF PEELING OFF DEVELOPER FROM A DEVELOPING SLEEVE

BACKGROUND

Field of the Disclosure

The present disclosure relates to a developing apparatus that develops an electrostatic latent image formed on an image carrying member with a developer containing toner and carrier.

Description of the Related Art

A developing apparatus includes a developing sleeve as a rotatable developer carrying member that carries two-component developer containing toner and carrier (this developer is hereinafter simply referred to as developer). A magnet (developing magnet) that includes a plurality of magnetic poles and generates a magnetic field for carrying developer on a surface of the developing sleeve is provided non-rotatably and stationarily inside the developing sleeve. The developer carried on the surface of the developing sleeve is fed to an area (developing area) where an electrostatic latent image formed on a photosensitive drum serving as an image carrying member is developed. When the developer carried on the surface of the developing sleeve is subjected to the development in the developing area, toner in the developer is consumed and a concentration of toner in the developer decreases.

The developer that is subjected to the development and has a decreased toner concentration is fed to an area (peeling area) where a repulsive magnetic field is formed between magnetic poles of the same polarity of the magnet. In the peeling area, a force for causing the developer that is subjected to the development in the developing area and has a decreased toner concentration to be removed from the developing sleeve acts on the developer. The developer removed from the developing sleeve in the peeling area is collected in a developing container. The developer collected in the developing container is agitated and mixed with the developer that is already present in the developing container, so that the concentration of toner is made uniform.

If the developer subjected to the development is not fully removed from the developing sleeve, the developer with a decreased toner concentration is subjected to the development again in the developing area along with the rotation of the developing sleeve. As a result, nonuniformity in the concentration of toner contained in the developer subjected to the development occurs, which may cause a defective image. This causes an issue during formation of a solid image. Thus, it is required to fully remove the developer that is subjected to the development and has a decreased toner concentration from the developing sleeve.

In a developing apparatus discussed in Japanese Patent Application Laid-Open No. 2002-148921, a rotatable peeling-off roller having a magnet body inside thereof is provided in the vicinity of a peeling-off magnetic pole of a magnetic field generation unit. This developing apparatus causes developer carried on a developer carrying member to be adsorbed onto the rotatable peeling-off roller side by the magnetic pole in the rotatable peeling-off roller. With this configuration, developer peelability in the vicinity of the peeling-off magnetic pole are improved.

To secure the developer peelability, it is necessary to ensure a sufficiently long distance along an outer peripheral surface of the developing sleeve between magnetic poles of the same polarity that form the peeling area. However, the outer diameter of the developing sleeve has recently been decreased due to the miniaturization of the developing apparatus. If the number of magnetic poles of the magnet is not changed, the distance along the outer peripheral surface of the developing sleeve between the magnetic poles tends to decrease as the outer diameter of the developing sleeve decreases. As a result, it is difficult to ensure a sufficiently long distance along the outer peripheral surface of the developing sleeve between the magnetic poles of the same polarity that form the peeling area, so that the peeling area becomes narrower, which makes it difficult to remove the developer subjected to the development from the developing sleeve (which leads to deterioration in developer peelability).

In a case where the configuration in which a magnet is additionally provided at the outside of the developing sleeve in the vicinity of the peeling-off magnetic pole is employed, like in the peeling-off roller discussed in Japanese Patent Application Laid-Open No. 2002-148921, it may be necessary to form a space for providing an additional member at the outside of the developing sleeve in the developing apparatus, thereby leading to an increase in the size of the apparatus.

SUMMARY

Embodiments of the present disclosure are directed to enhancing the efficiency of peeling off developer from an outer peripheral surface of a developing sleeve between magnetic poles of the same polarity of a developing magnet, while achieving a reduction in the size of a developing apparatus.

According to an aspect of the present disclosure, a developing apparatus includes a rotatable developing member configured to carry and feed a developer containing toner and carrier to develop an electrostatic latent image formed on an image carrying member, and a magnet provided non-rotatably and stationarily inside the rotatable developing member and configured to include a first magnetic pole and a second magnetic pole that is provided adjacent to the first magnetic pole at a downstream side of the first magnetic pole with respect to a rotation direction of the rotatable developing member and has the same polarity as the first magnetic pole, wherein a distance along an outer peripheral surface of the rotatable developing member between a first maximum peak position, which corresponds to a maximum value of a magnetic flux density of the first magnetic pole with respect to a normal direction of the rotatable developing member, and a second maximum peak position, which corresponds to a maximum value of a magnetic flux density of the second magnetic pole with respect to the normal direction of the rotatable developing member, is less than 18 [mm], and wherein a distance along the outer peripheral surface of the rotatable developing member in a width of a value obtained by adding 2 [mT] to a minimum value of a magnetic flux density with respect to the normal direction of the rotatable developing member is greater than or equal to 5.5 [mm], at a downstream side of the first maximum peak position and at an upstream side of the second maximum peak position with respect to the rotation direction of the rotatable developing member.

According to another aspect of the present disclosure, a developing apparatus includes a rotatable developing member configured to carry and feed a developer containing toner and carrier to develop an electrostatic latent image formed on an image carrying member, and a magnet provided non-rotatably and stationarily inside the rotatable developing member and configured to include a first magnetic pole and a second magnetic pole that is provided adjacent to the first magnetic pole at a downstream side of the first magnetic pole with respect to a rotation direction of the rotatable developing member and has the same polarity as the first magnetic pole, wherein a distance along an outer peripheral surface of the rotatable developing member between a first maximum peak position, which corresponds to a maximum value of a magnetic flux density of the first magnetic pole with respect to a normal direction of the rotatable developing member, and a second maximum peak position, which corresponds to a maximum value of a magnetic flux density of the second magnetic pole with respect to the normal direction of the rotatable developing member, is less than 18 [mm], and wherein, in a case where a direction of a force by which a magnetic attraction in the normal direction of the rotatable developing member attracts the developer in a central direction of the rotatable developing member is negative, a distance along the outer peripheral surface of the rotatable developing member in a repulsion width in which the magnetic attraction in the normal direction of the rotatable developing member is a positive value at a downstream side of the first maximum peak position and at an upstream side of the second maximum peak position with respect to the rotation direction of the rotatable developing member is greater than or equal to 4.7 [mm].

Further features of the present disclosure will become apparent from the following description of exemplary embodiments with reference to the attached drawings.

DESCRIPTION OF THE EMBODIMENTS

Exemplary embodiments of the present disclosure will be described in detail below with reference to the accompanying drawings. The following exemplary embodiments are not meant to limit the scope of the present disclosure as encompassed by the appended claims. Further, not all combinations of features described in the exemplary embodiments are essential to one or more embodiments of the present disclosure. The present disclosure can be carried out in various applications such as various printers, a copying machine, a facsimile (FAX), and a multifunction peripheral.

<Configuration of Image Forming Apparatus>

A configuration of an image forming apparatus according to a first exemplary embodiment of the present disclosure will be described with reference to FIG. 1.

Figure 1:
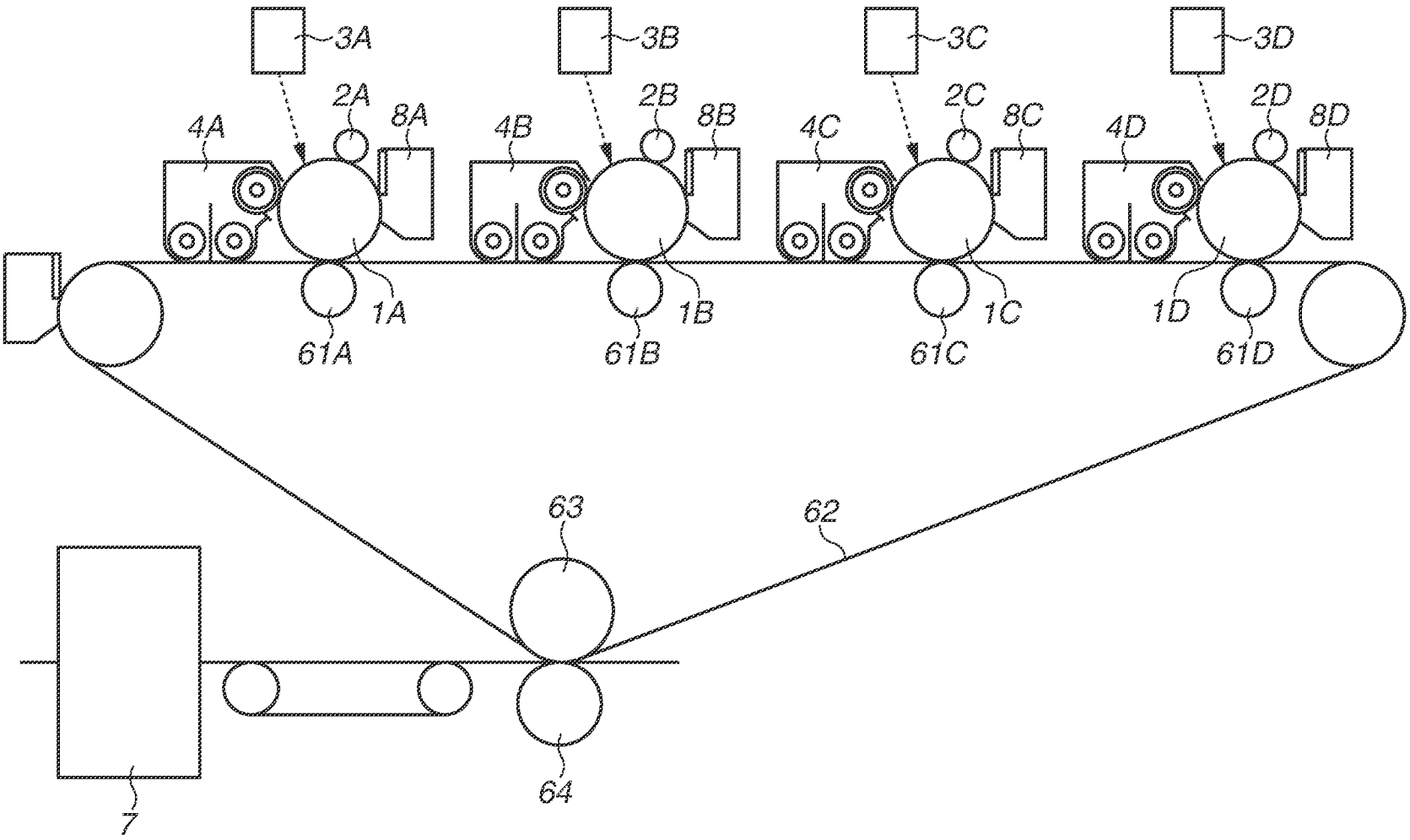
FIG. 1 is a sectional view illustrating a configuration of an image forming apparatus according to a first exemplary embodiment.

As illustrated in FIG. 1, the image forming apparatus employs a tandem system. Drum cartridges for forming toner images of four colors, i.e., yellow, magenta, cyan, and black, are provided in the image forming apparatus. In the following description, the components denoted by reference numerals without using symbols A, B, C, and D are portions that are common to the four-color drum cartridges illustrated in FIG. 1.

Image formation in the image forming apparatus is carried out as follows. A surface of a photosensitive drum 1 is uniformly charged by a charging apparatus 2. The charged surface is exposed to light by a laser 3, thereby forming an electrostatic latent image on the surface of the photosensitive drum 1. A developing apparatus 4 supplies toner to adhere to the electrostatic latent image thus formed, thereby developing the electrostatic latent image into a toner image. The toner image is transferred onto an intermediate transfer belt 62 by a primary transfer roller 61. The toner images of a plurality of colors are superimposed and transferred onto the intermediate transfer belt 62, and then four-color toner images are transferred onto a recording medium that is fed from a sheet feed cassette to a secondary transfer portion where a secondary transfer roller 63 and a secondary transfer outer roller 64 are brought into contact with each other. The recording medium is heated and pressurized by a fixing apparatus 7, and is then discharged to an outside of the image forming apparatus. Residual toner remaining on the surface of the photosensitive drum 1 after such transfer process is removed by a cleaner 8.

<Configuration of Developing Apparatus>

A configuration of the developing apparatus 4 will be described with reference to a sectional view illustrated in FIG. 2 and a schematic view illustrated in FIG. 3.

The developing apparatus 4 includes a developing sleeve 41 that is rotatable and nonmagnetic (rotatable developing member). The developing sleeve carries and feeds a developer containing toner and carrier to develop the electrostatic latent image formed on the surface of the photosensitive drum 1. A magnet 42 serving as a magnetic field generation unit is provided non-rotatably and stationarily inside the developing sleeve 41.

The developing apparatus 4 further includes a regulating blade 43 and a developing container 44. The regulating blade 43 is a developer regulating member that regulates a height of magnetic bristles formed on the developing sleeve 41 (an amount of toner to be carried on the surface of the developing sleeve 41). The developing container 44 contains the developer containing toner and carrier. In the developing container 44, a developing chamber 44*a* and an agitating chamber 44*b* are partitioned by a partition wall 47 that extends in a vertical direction. The developing chamber 44*a* is provided with a first screw 45*a*, and the agitating chamber 44*b* is provided with a second screw 45*b*. The first screw 45*a* agitates the developer in the developing chamber 44*a* and feeds the developer in a first direction. The second screw 45*b* agitates the toner supplied from a toner supply layer and the developer contained in the agitating chamber 44*b*, and feeds the developer in a second direction opposite to the first direction to make uniform a toner concentration.

In the first exemplary embodiment, the developer contained in the developing container 44 is two-component developer in which negatively-charged non-magnetic toner is mixed with magnetic carrier. The nonmagnetic toner contains a coloring agent, a wax component, and the like in resin, such as polyester and styrene, and is powdered by pulverization or polymerization. The magnetic carrier is obtained by resin coating applied to a surface layer of a core composed of a resin particle obtained by kneading ferrite particles or magnetic powders.

The developing sleeve 41 used in the first exemplary embodiment has a cylindrical shape with an outer diameter of 20 [mm] or less, and is made of aluminum. Specifically, in the first exemplary embodiment, the outer diameter of the developing sleeve 41 is 18 [mm]. An outer peripheral surface of the developing sleeve 41 is provided with recessed grooves formed at regular intervals in a longitudinal direction of the developing sleeve 41 (in a rotational axis direction of the developing sleeve 41). The grooves formed on the outer peripheral surface of the developing sleeve 41 when viewed along a section perpendicular to the rotational axis of the developing sleeve 41 are each formed in a triangular shape with a depth of 60 [μm] and a width of 120 [μm]. Sixty grooves are formed at regular intervals in a circumferential direction.

Specifically, a plurality of grooves is formed over an entire area of the outer peripheral surface of the developing sleeve 41 in the circumferential direction of the developing sleeve 41. The grooves are formed at predetermined intervals in the circumferential direction of the developing sleeve 41. These grooves are deeply related to a force for feeding the developer by the developing sleeve 41. The feeding force increases as the depth, the width, and the number of grooves increase, and the amount of developer to be carried on the surface of the developing sleeve 41 can be stabilized for a long period of time. On the other hand, if the feeding force is excessively increased by such features of the grooves, it is difficult to peel off the developer from the surface of the developing sleeve 41.

A detailed configuration of the magnet 42 will be described. The magnet 42 used in the first exemplary embodiment includes five magnet pieces 42*a* to 42*e*. Further, the magnet 42 used in the first exemplary embodiment includes a plurality of magnetic poles, and the number of the magnetic poles is five. The developing sleeve 41 is rotated in a direction indicated by an arrow in FIG. 2 (counterclockwise), and feeds the developer adsorbed at a position corresponding to a scooping magnetic pole S1, which is formed in the vicinity of the first magnet piece 42*a*, toward the regulating blade 43. A layer thickness of developer bristled by a regulating magnetic pole N1 formed in the vicinity of the second magnet piece 42*b* is regulated by the regulating blade 43. When the developer passes through a gap between the developing sleeve 41 and the regulating blade 43, a developer layer with a predetermined layer thickness is formed on the surface of the developing sleeve 41. The developer layer is carried and fed to a developing area opposed to the photosensitive drum 1, and the electrostatic latent image formed on the surface of the photosensitive drum 1 is developed in a state where magnetic bristles are formed by a development magnetic pole S2 that is formed in the vicinity of the third magnet piece 42*c*. In other words, the developing area opposed to the photosensitive drum 1 is an area where the magnetic bristles contact the surface of the photosensitive drum 1. The developer subjected to the development is fed to a peeling area through a carrying magnetic pole N2 that is formed in the vicinity of the fourth magnet piece 42*d*.

Figure 2:
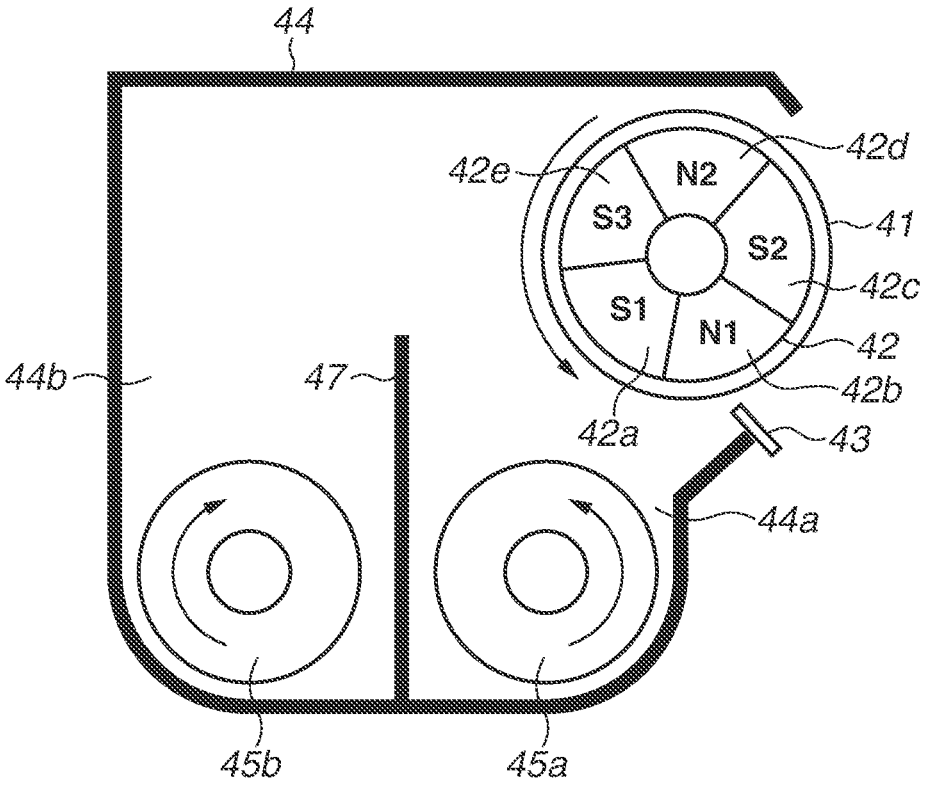
FIG. 2 is a sectional view illustrating a configuration of a developing apparatus according to the first exemplary embodiment.

As illustrated in FIG. 2, the scooping magnetic pole S1 is provided at a position adjacent to a peeling magnetic pole S3 at a downstream side of the peeling magnetic pole S3 with respect to a rotation direction of the developing sleeve 41, and has the same polarity as the peeling magnetic pole S3. Thus, the developer carried onto the surface of the developing sleeve 41 is peeled off by a repulsive magnetic field formed between the magnetic poles of the same polarity (i.e., the peeling magnetic pole S3 and the scooping magnetic pole S1) of the magnet 42. An area between the peeling magnetic pole S3 and the scooping magnetic pole S1 in the rotation direction of the developing sleeve 41 is hereinafter referred to as a peeling area.

In the peeling area, the developer is peeled off by a repulse magnetic field between the peeling magnetic pole S3 and the scooping magnetic pole S1 of the same polarity. The peeled developer falls down into the developing chamber 44*a* and is agitated and fed by the first screw 45*a*, and then is adsorbed onto the developing sleeve 41 by the scooping magnetic pole S1. If the developer is not fully peeled off in the peeling area, the developer that is subjected to the development once and has a decreased toner concentration is scooped on the developing sleeve 41 by the scooping magnetic pole S1 without involving the agitation and feeding process by the first screw 45*a* and the second screw 45*b*. If the developer with a decreased toner concentration is fed to the developing area, an image with a decreased image density is output. A phenomenon in which the developer is not fully peeled off and is delivered from the peeling magnetic pole S3 to the scooping magnetic pole S1 is referred to as a dragging phenomenon.

As illustrated in FIG. 2, in the first exemplary embodiment, a position where the regulating blade 43 is closest to the developing sleeve 41 when viewed along a section perpendicular to the rotational axis of the developing sleeve 41 is vertically below the rotation center of the developing sleeve 41. Such a system (lower blade system) has the following features as compared with a system (upper blade system) in which a position where the regulating blade 43 is closest to the developing sleeve 41 is vertically above the rotation center of the developing sleeve 41. In the lower blade system, the amount of developer to be scooped on the developing sleeve 41 can be stabilized even in a state where the amount of developer contained in the developing chamber 44*a* is small, as compared with the upper blade system. On the other hand, in the lower blade system, a gravitational force acts on the developer peeled off in the peeling area in the direction of the scooping magnetic pole S1. Accordingly, in the lower blade system, the dragging phenomenon is more likely to occur than in the upper blade system.

To prevent the dragging phenomenon from occurring, it is required to increase a space between the peeling magnetic pole S3 and the scooping magnetic pole S1. In a case where the outer diameter of the developing sleeve 41 is 18 [mm], it is desirable to set a distance along the outer peripheral surface of the developing sleeve 41 between the peeling magnetic pole S3 and the scooping magnetic pole S1 to 18 [mm] or more by setting an angle formed between the peeling magnetic pole S3 and the scooping magnetic pole S1 to 110° or more.

The distance along the outer peripheral surface of the developing sleeve 41 between the peeling magnetic pole S3 and the scooping magnetic pole S1 indicates a distance along the outer peripheral surface of the developing sleeve 41 between a position where a magnetic flux density Br of a normal direction component of the peeling magnetic pole S3 has a maximum peak (maximum value) and a position where the magnetic flux density Br of a normal direction component of the scooping magnetic pole S1 has a maximum peak (maximum value). The magnetic flux density Br of the normal direction component of the peeling magnetic pole S3 is a magnetic flux density of the peeling magnetic pole S3 in the normal direction of the developing sleeve 41. The magnetic flux density Br of the normal direction component of the scooping magnetic pole S1 is a magnetic flux density of the scooping magnetic pole S1 in the normal direction of the developing sleeve 41.

To improve peelability of the developer, it is necessary to ensure a sufficiently long distance along the outer peripheral surface of the developing sleeve 41 between the magnetic poles of the same polarity (between the peeling magnetic pole S3 and the scooping magnetic pole S1) that form the peeling area. However, the outer diameter of the developing sleeve has recently been decreased (specifically, the outer diameter of the developing sleeve is 20 [mm] or less) due to the miniaturization of the developing apparatus. In a case where the same number of magnetic poles are included in the magnet, there is a tendency that the distance along the outer peripheral surface of the developing sleeve between the magnetic poles is less than 18 [mm] as the outer diameter of the developing sleeve decreases. As a result, it is difficult to ensure a sufficiently long distance along the outer peripheral surface of the developing sleeve 41 between the magnetic poles of the same polarity that form the peeling area, so that the peeling area becomes narrower, which makes it difficult to peel off the developer subjected to the development from the developing sleeve 41 (which leads to deterioration in the peelability of the developer). This phenomenon is remarkable, in particular, in a case where a configuration with the lower blade system in which the dragging phenomenon is more likely to occur than in the upper blade system is employed for the developing apparatus 4, in addition to the decrease of the outer diameter of the developing sleeve 41 to miniaturize the developing apparatus 4.

In the first exemplary embodiment, the outer diameter of the developing sleeve 41 is decreased (specifically, the outer diameter of the developing sleeve is set to 20 [mm] or less) and the lower blade system is employed as the configuration of the developing apparatus 4. Specifically, the outer diameter of the developing sleeve 41 is set to 18 [mm], the angle formed between the peeling magnetic pole S3 and the scooping magnetic pole S1 is set to 104.2°, and the distance along the outer peripheral surface of the developing sleeve 41 between the peeling magnetic pole S3 and the scooping magnetic pole S1 is set to 16.4 [mm]. According to the first exemplary embodiment, in the configuration in which the distance along the outer peripheral surface of the developing sleeve 41 between the peeling magnetic pole S3 and the scooping magnetic pole S1 is less than 18 [mm], the improvement in the peelability of the developer and the miniaturization of the apparatus can be achieved. These effects will be described in detail below.

<Features of the Present Disclosure>

A force for attracting developer to the developing sleeve 41 will be described. The force for attracting developer to the developing sleeve 41 can be expressed by a magnetic attraction Fr obtained by the following equation 1.

$$F_r = \frac{\mu - \mu_0}{\mu_0(\mu + 2\mu_0)} 2\pi b^3 \left( B_r \frac{\partial B_r}{\partial r} + B_\theta \frac{\partial B_\theta}{\partial r} \right) \quad (1)$$

where "μ" represents a magnetic permeability of the magnetic carrier, "$\mu_0$" represents a magnetic permeability in vacuum, "b" represents the radium of the magnetic carrier, and "Br" represents the normal direction component of the developing sleeve 41 in the magnetic flux density. The magnetic density Br was measured using a magnetic field measuring instrument "MS-9902" (product name) manufactured by F. W. BELL Inc. as a measuring instrument, assuming that a distance between the surface of the developing sleeve 41 and a probe, which is a member of the measuring instrument, is about 100 μm.

"$B_\theta$" is obtained by the following equation (2) using the value Br measured by the above-described method.

$$B\theta = \frac{\partial A_z(r, \theta)}{\partial r} \quad (2)$$

$$\left( A_z(R, \theta) = \int_0^\theta R B_r d\theta \right)$$

where $B_\theta$ is derived using the value Br measured as described above to calculate Fr.

Figure 4A:
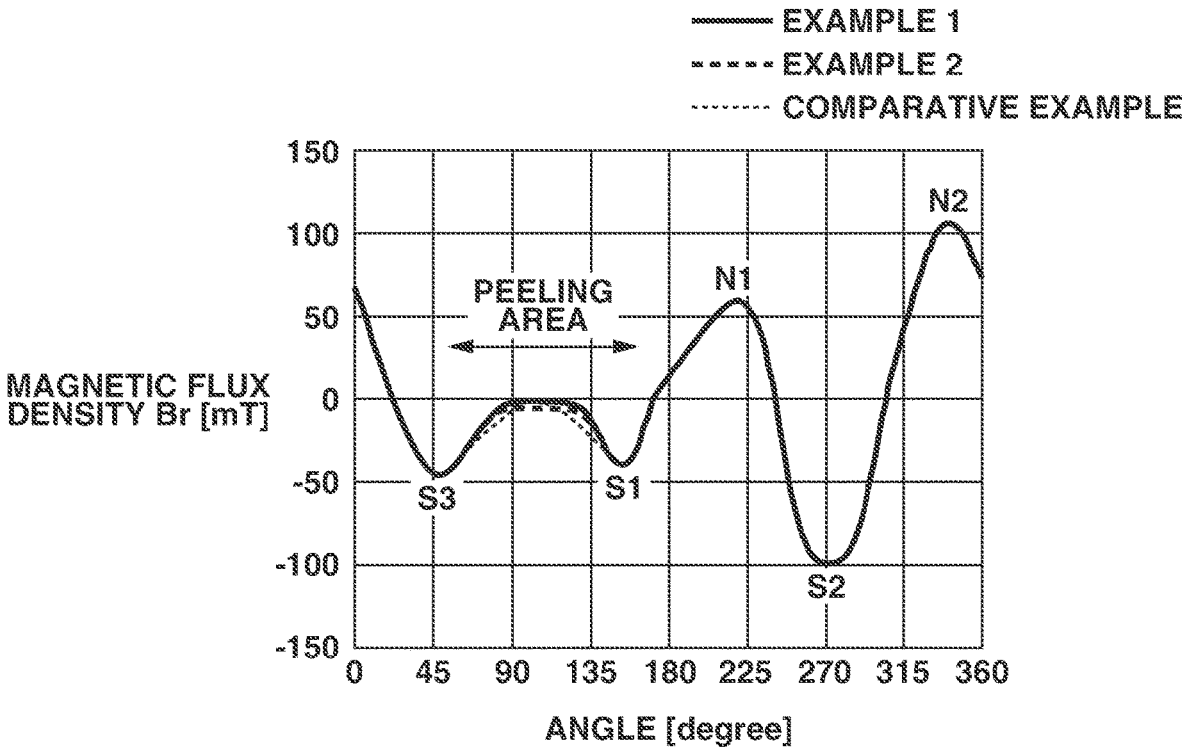
FIGS. 4A and 4B are graphs each illustrating a distribution of a magnetic flux density Br in configurations according to Example 1, Example 2, and Comparative Example.
Figure 4B:
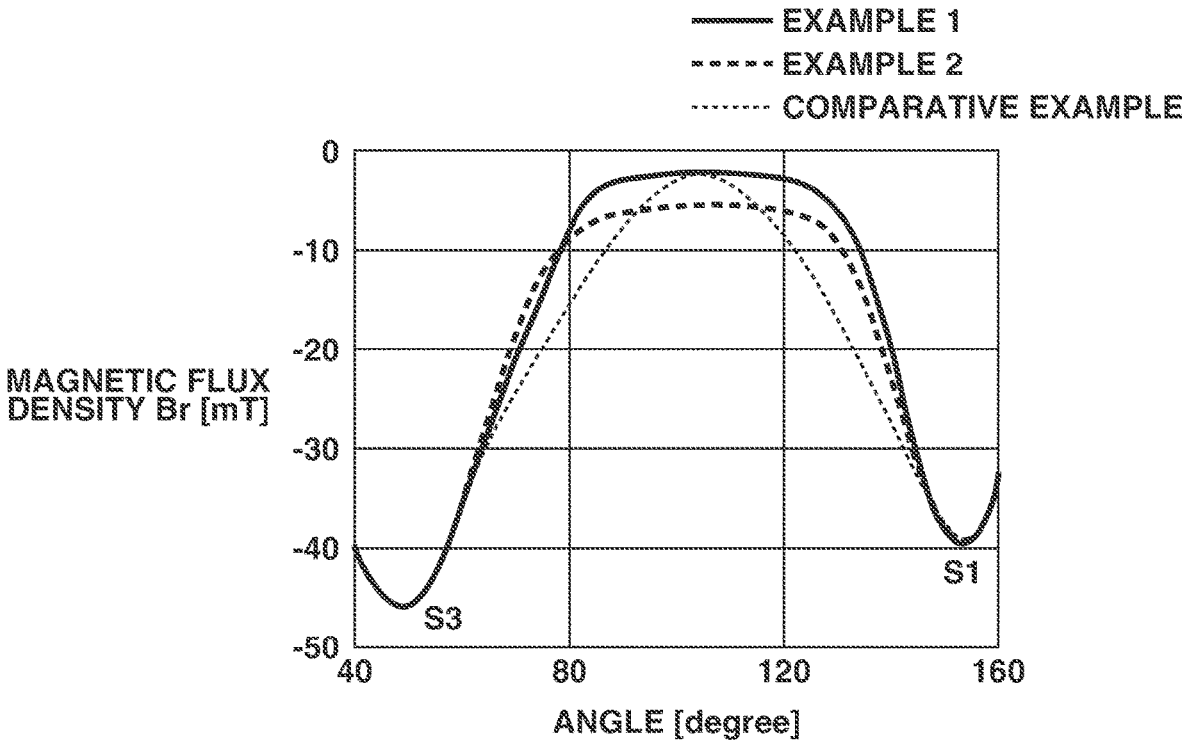

FIGS. 4A and 4B are graphs each illustrating a distribution of the magnetic flux density Br (hereinafter simply referred to as "Br") in the normal direction of the developing sleeve 41 in configurations according to "Example 1", "Example 2", and "Comparative Example", which illustrates an example of the Br pattern of the related art, as examples of the Br pattern for obtaining the effects of the present disclosure. FIG. 4B is an enlarged graph in an area in the vicinity of the peeling area in FIG. 4A. FIGS. 4A and 4B illustrate the magnetic flux density Br when an N-pole is set in a positive direction and an S-pole is set in a negative direction. Example 1, Example 2, and Comparative Example differ from one another in regard to the distribution of Br in the vicinity of the peeling area. On the other hand, configurations for the distribution of Br in areas other than the peeling area (e.g., the vicinity of the developing area) in Example 1, Example 2, and Comparative Example are substantially the same.

As described above, in the first exemplary embodiment, the distance along the outer peripheral surface of the developing sleeve 41 between the peeling magnetic pole S3 and the scooping magnetic pole S1 is set to 16.4 [mm], and the rotation angle of the developing sleeve 41 is set to 104.2°. FIGS. 4A and 4B illustrate Br that is obtained when the fifth magnet piece 42*e* (magnet piece constituting the peeling magnetic pole S3) and the first magnet piece 42*a* (magnet piece constituting the scooping magnetic pole S1) are magnetized and disposed in Comparative Example.

In Example 1, a magnetization process is added between the fifth magnet piece 42*e* and the first magnet piece 42*a* after the magnet pieces 42*a* to 42*e* are magnetized and disposed, like in the configuration according to Comparative Example, to thereby intentionally change the shape of Br in the vicinity of the peeling area. In Example 2, when the magnetization process is added between the fifth magnet piece 42*e* and the first magnet piece 42*a*, a magnetization intensity is increased as compared with Example 1.

According to Example 1, in the peeling area, Br rapidly changes from the peeling magnetic pole S3, and then an area in which an absolute value of Br is small and the change in Br is small is continued to a certain extent, and Br rapidly changes again toward the scooping magnetic pole S1, as compared with Comparative Example. In addition to the characteristics of the change in Br in Example 1, Example 2 is characterized in that an absolute value of a minimum peak value (minimum value) of Br in the peeling area is large.

In this case, the absolute value of the minimum peak value (minimum value) of Br in the peeling area (in other words, an area that is located at a downstream side of the maximum peak position of Br of the peeling magnetic pole S3 and is located at an upstream side of the maximum peak position of Br of the scooping magnetic pole S1 with respect to the rotation direction of the developing sleeve 41) is defined as a "Br minimum value". As an index indicating a state of a change in Br in the peeling area, a width of a value obtained by adding 2 [mT] to the Br minimum value in a polarity direction of the magnetic pole that forms the peeling area is defined as a "(Br minimum value+2 mT) width". The degree of a behavior where Br more rapidly changes from the peeling magnetic pole S3 increases, then the area in which the absolute value of Br is small and the change in Br is small continues, and Br rapidly changes again toward the scooping magnetic pole S1 increases, as the value of the "(Br minimum value+2 mT)" width increases.

Table 1 illustrates characteristic configurations for the Br pattern in the configurations according to Example 1, Example 2, and Comparative Example.

TABLE 1

| | Example 1 | Example 2 | Related Art |
|---|---|---|---|
| Distance between poles S3 and S1 [mm] | 16.4 | 16.4 | 16.4 |
| Angle between poles S3 and S1 [degree] | 104.2 | 104.2 | 104.2 |
| (Br minimum value + 2 mT) width [mm] | 6.6 | 6.6 | 2.6 |
| (Br minimum value + 2 mT) width [degree] | 42.2 | 42.1 | 16.4 |
| Br minimum value [mT] | 2.2 | 5.4 | 2.3 |

As illustrated in Table 1, when Examples 1 and 2 are compared with Comparative Example (Related Art), the distance along the outer peripheral surface of the developing sleeve 41 between the peeling magnetic pole S3 and the scooping magnetic pole S1 and the angle formed between the peeling magnetic pole S3 and the scooping magnetic pole S1 in Example 1 and Example 2 are equal to those in Comparative Example, while the "(Br minimum value+2 mT) width" in Example 1 and Example 2 is greater than that in Comparative Example. In addition, the absolute value (Br minimum value) of the minimum peak value (minimum value) of Br in the peeling area in Example 2 is greater than that in Example 1.

Figure 5A:
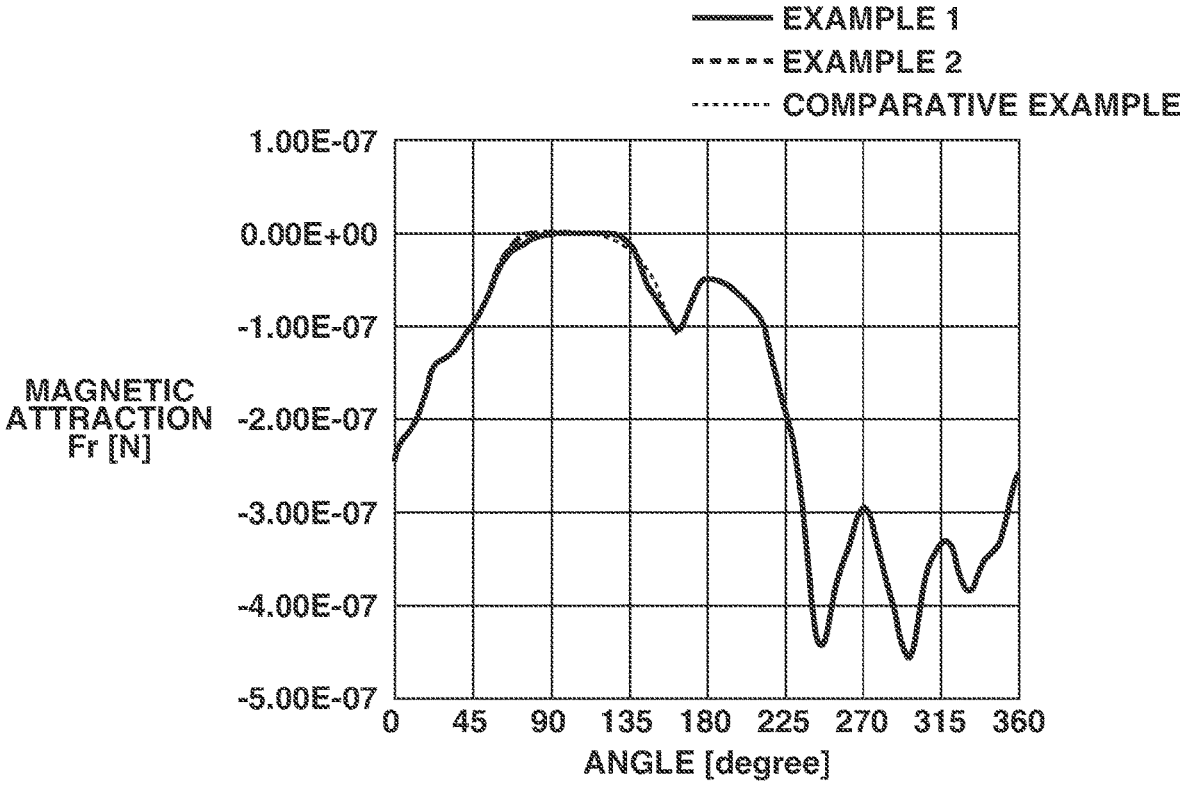
FIGS. 5A and 5B are graphs each illustrating a distribution of a magnetic attraction Fr in the configurations according to Example 1, Example 2, and Comparative Example.
Figure 5B:
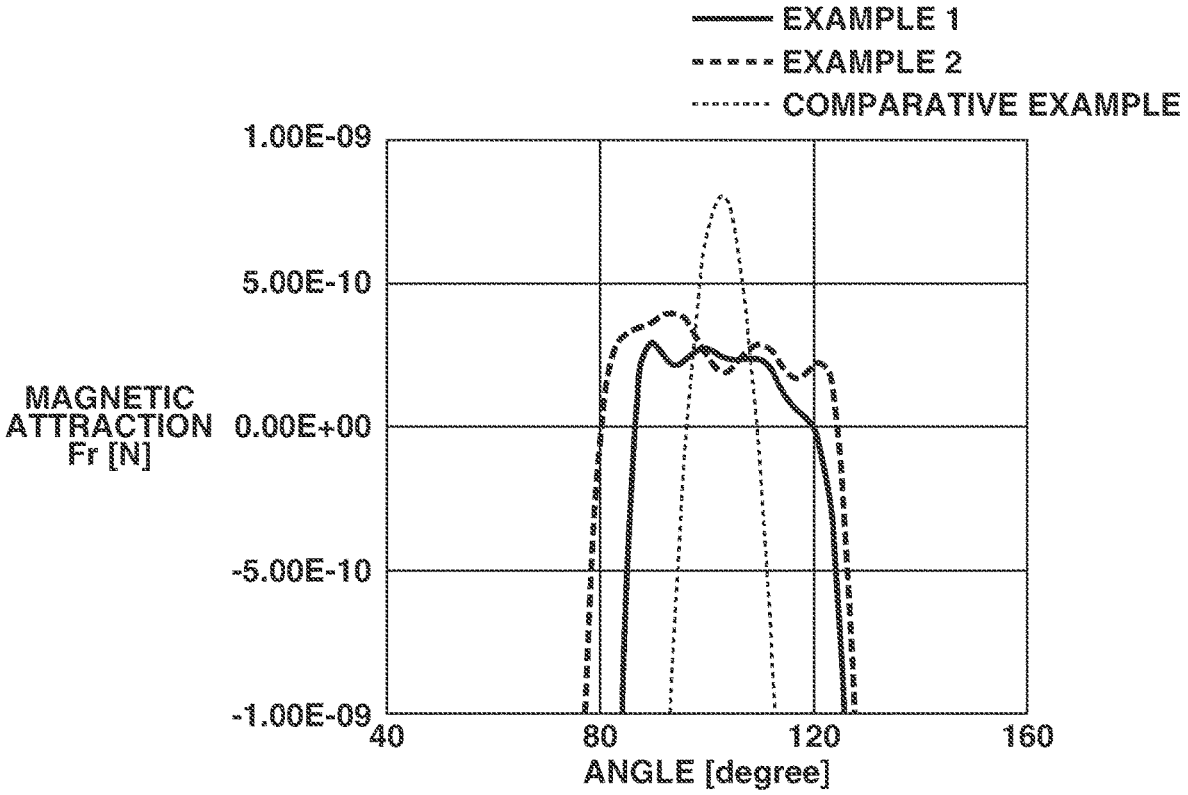

FIGS. 5A and 5B are graphs each illustrating Fr patterns obtained when Fr is calculated based on equations 1 and 2 for the respective Br patterns according to Example 1, Example 2, and Comparative Example illustrated in FIGS. 4A and 4B. FIGS. 5A and 5B are graphs each illustrating a distribution of the magnetic attraction Fr in the configurations according to Example 1, Example 2, and Comparative Example. FIG. 5B is an enlarged graph in an area in the vicinity of the peeling area. Fr is calculated assuming that the magnetic permeability of the magnetic carrier is 5 and a radius of the magnetic carrier is 25 μm. An angle represented on the horizontal axis in FIGS. 5A and 5B is defined assuming that the vertically upward direction is 0° and the rotation direction of the developing sleeve 41 corresponds to the positive direction.

Fr represents a force in the normal direction of the developing sleeve 41 (magnetic attraction in the normal direction of the developing sleeve 41) in forces acting on the magnetic carrier. When the force Fr takes a negative value, an attracting force in a central direction of the developing sleeve 41 acts on the magnetic carrier (developer). When Fr takes a positive value, a force (repulsive force) for peeling off developer from the developing sleeve 41 acts on the developer. In other words, in a case where a direction of a force in which the magnetic attraction Fr with respect to the normal direction of the developing sleeve 41 attracts the magnetic carrier (developer) in the central direction of the developing sleeve 41 is negative, a direction of the repulsive force is positive.

Specifically, the developer is peeled off in an area where Fr>0 is satisfied. The peelability of the developer is improved as the area where Fr>0 is satisfied increases, while the dragging phenomenon is more likely to occur as the area where Fr>0 is satisfied decreases. The area where Fr>0 is satisfied is hereinafter referred to as a "repulsion width". Table 2 illustrates the distance along the outer peripheral surface of the developing sleeve 41 in the repulsion width and the rotation angle of the developing sleeve 41 in the respective Br patterns according to Example 1, Example 2, and Comparative Example.

TABLE 2

| | Example 1 | Example 2 | Related Art |
|---|---|---|---|
| Repulsion width [mm] | 5.3 | 7.1 | 2.2 |
| Repulsion width [degree] | 34.1 | 45.2 | 14.6 |

Figure 6A:
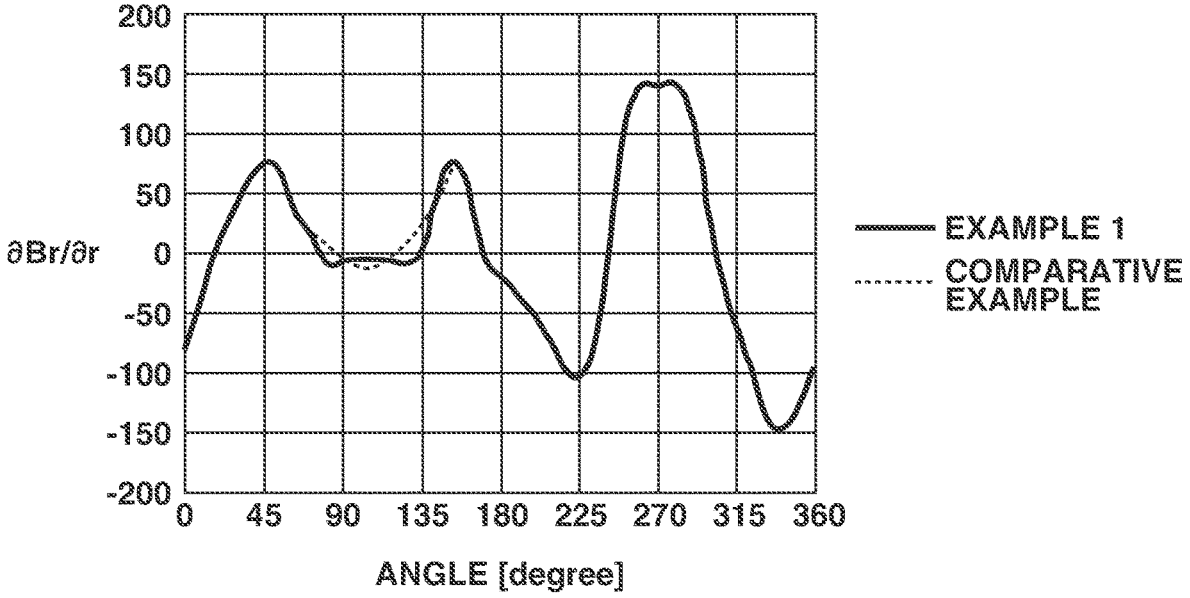
FIGS. 6A and 6B are graphs each illustrating a distribution of ∂Br/∂r in the configurations according to Example 1 and Comparative Example.
Figure 6B:
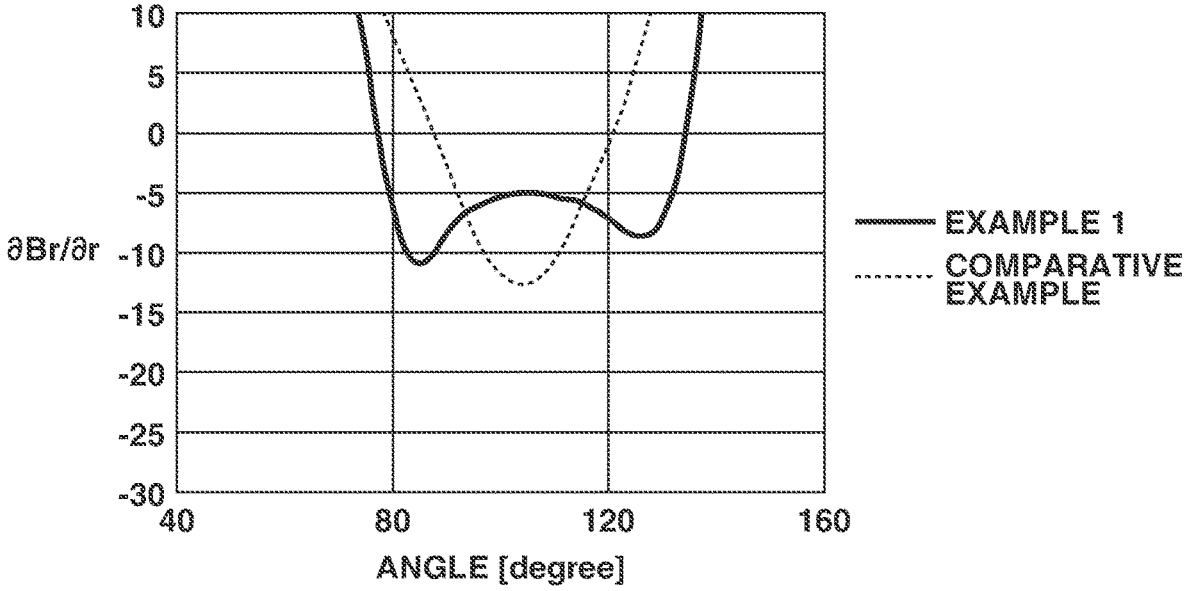

As seen from Table 2, the repulsion width in each of Example 1 and Example 2 is increased as compared with Comparative Example (Related Art). The reason why the repulsion width in the configuration according to Example 1 is increased as compared with Comparative Example will now be described. In equation 1, the portion corresponding to "∂Br/∂r" most contributes to an increase in the repulsion width. FIGS. 6A and 6B are graphs each illustrating ∂Br/∂r in Br patterns in the configurations according to Example 1 and Comparative Example. FIG. 6B is an enlarged graph in an area in the vicinity of the peeling area.

As illustrated in FIG. 4B, Br always takes a negative value (S-pole) in the peeling area. Accordingly, in the peeling area, when ∂Br/∂r is negative, a first term in equation (1) is a positive value (repulsive force). As illustrated in FIG. 6B, the area where ∂Br/∂r is negative in Example 1 is larger than that in Comparative Example.

This is because a boundary between an area where the magnetic flux density Br increases in a direction away from the developing sleeve 41 and an area where the magnetic flux density Br decreases in a direction away from the developing sleeve 41 is located at an outer side, as the "(Br minimum value+2 mT) width" is made increased. Thus, an area where the first term in equation (1) is a positive value increases, so that the repulsion width in which Fr>0 is satisfied increases.

In addition, the repulsion width in the configuration according to Example 2 is further increased as compared with Example 1. This is because the value of the first term in equation (1) is made increased by increasing the Br minimum value. In a case where only this effect is considered, the repulsion width increases as the Br minimum value increases. However, if the Br minimum value is excessively large, the area where ∂Br/∂r takes a negative value decreases, which may result in a decrease in the repulsion width. The decrease in the repulsion width is conspicuous in a case where the Br minimum value is 9 [mT] or more. Accordingly, in order to ensure a sufficiently large repulsion width, the Br minimum value in the peeling area is desirably in a range from 0 [mT] to 9 [mT]. To obtain the effect of further increasing the repulsion width as illustrated in Example 2, the Br minimum value in the peeling area is more desirably in a range from 3 [mT] to 9 [mT].

A study was conducted in the same manner as described above in a state where the "(Br minimum value+2 mT) width" was more finely set, while the distance along the outer peripheral surface of the developing sleeve 41 between the peeling magnetic pole S3 and the scooping magnetic pole S1 was fixed to 16.4 [mm] and the Br minimum value was fixed to 3.0 [mT]. Table 3 illustrates the results obtained by visually observing the repulsion width set in this case, the difference A between the reflection density on the first sheet and the reflection density on the tenth sheet, and the difference between the density on the first sheet and the density on the tenth sheet.

In the evaluation by visual observation, an obviously unacceptable difference is represented by "D", an allowable maximum difference is represented by "C", an allowable small difference is represented by "B", and no difference observed by visual observation is represented by "A".

TABLE 3

| | | | | | | | |
|---|---|---|---|---|---|---|---|
| (Br minimum value + 2 mT width) [mm] | 4.0 | 4.8 | 5.3 | 5.5 | 6.1 | 6.3 | 6.8 |
| (Br minimum value + 2 mT width) [degree] | 25.5 | 30.6 | 33.7 | 35.0 | 38.8 | 40.0 | 43.3 |
| Repulsion width [mm] | 3.5 | 4.0 | 4.5 | 4.7 | 5.3 | 5.7 | 6.2 |
| Repulsion width [degree] | 22.0 | 25.5 | 28.5 | 30.1 | 34.0 | 36.0 | 39.4 |
| Difference Δ in reflection density | 0.18 | 0.14 | 0.10 | 0.08 | 0.07 | 0.05 | 0.03 |
| Evaluation of density difference by visual observation | D | D | C | B | B | A | A |

To verify the effects of the first exemplary embodiment, a decrease in the image density of a solid image was measured by continuously supplying 10 sheets of A4-size with the solid image formed thereon in a case where the configurations according to Example 1, Example 2, and Comparative Example were used. The value of the density was measured using reflection spectral densitometer 500 series manufactured by X-Rite Inc., and the value was obtained by averaging values at 10 points in a main scanning direction at the center in a sub-scanning direction of an output image.

When a difference between a reflection density value on the first sheet and a reflection density value on the tenth sheet is represented by Δ, Δ=0.05 in the configuration according to Example 1, Δ=0.02 in the configuration according to Example 2, and Δ=0.22 in the configuration according to Comparative Example. That is, the measurement result indicates that the dragging phenomenon is suppressed in Example 1 and Example 2 as compared with Comparative Example.

The first exemplary embodiment described above illustrates a configuration in which the distance along the outer peripheral surface of the developing sleeve 41 between the peeling magnetic pole S3 and the scooping magnetic pole S1 is less than 18 [mm]. Specifically, the distance is set to 16.4 [mm] and the rotation angle of the developing sleeve 41 is set to 104.2°. In Comparative Example, a normal Br pattern is obtained in a configuration in which the distance along the outer peripheral surface of the developing sleeve 41 between the peeling magnetic pole S3 and the scooping magnetic pole S1 is less than 18 [mm], so that the dragging phenomenon occurs. On the other hand, in Example 1 and Example 2, even in the configuration in which the distance along the outer peripheral surface of the developing sleeve 41 between the peeling magnetic pole S3 and the scooping magnetic pole S1 is small, the repulsion width can be increased by devising the Br pattern in the peeling area, so that the peelability of the developer can be improved and the dragging phenomenon can be suppressed.

To suppress the dragging phenomenon to such an extent that a decrease in the image density is at an acceptable level in the repulsion width in which the magnetic attraction Fr with respect to the normal direction of the developing sleeve 41 is a positive value, the distance along the outer peripheral surface of the developing sleeve 41 needs to be desirably set to 4.7 [mm] and the rotation angle needs to be desirably set to 30° or more. To enhance the effect of suppressing the dragging phenomenon, the distance along the outer peripheral surface of the developing sleeve 41 can be more desirably set to 5.7 [mm] and the rotation angle can be more desirably set to 36° or more. To achieve this, in the "(Br minimum value+2 mT) width", the distance along the outer peripheral surface of the developing sleeve 41 needs to be desirably set to 5.5 [mm] and the rotation angle needs to be desirably set to 35° or more. The distance along the outer peripheral surface of the developing sleeve 41 can be more desirably set to 6.3 [mm] and the rotation angle can be more desirably set to 40° or more.

The "(Br minimum value+2 mT) width" can be increased not only by devising magnetization conditions for providing magnetic properties to the magnet pieces 42*a* to 42*e*, like in the first exemplary embodiment, but also by devising a shape of each of the magnet pieces 42*a* to 42*e* in the magnet 42. Any of such methods can be used to obtain the effects of the first exemplary embodiment.

As described above, the first exemplary embodiment employs the configuration in which the distance along the outer peripheral surface of the developing sleeve 41 between the peeling magnetic pole S3 and the scooping magnetic pole S1 is less than 18 [mm]. Further, in the first exemplary embodiment, the absolute value of the minimum peak value (minimum value) of Br in the peeling area is defined as the "Br minimum value", and the width of the value obtained by adding 2 [mT] to the Br minimum value is defined as the "(Br minimum value+2 mT) width" as the index indicating the state of the change in the peeling area. Further, in the first exemplary embodiment, the "(Br minimum value+2 mT) width" is increased as a distribution of Fr in the peeling area in the configuration in which the distance along the outer peripheral surface of the developing sleeve 41 between the magnetic poles of the same polarity (the peeling magnetic pole S3 and the scooping magnetic pole S1) that form the peeling area. According to the first exemplary embodiment as described above, the peelability of the developer can be secured even when the developing apparatus 4 is miniaturized and the outer diameter of the developing sleeve 41 is decreased. Consequently, the improvement in the peelability of the developer and the miniaturization of the apparatus can be achieved.

The present disclosure is not limited to the above-described exemplary embodiments. Various modifications (including organic combinations of the exemplary embodiments) can be made based on the gist of the present disclosure, and these modifications should not to be excluded from the scope of the present disclosure.

While the above-described exemplary embodiments illustrate an example of the developing apparatus having the configuration in which the magnet 42 includes a plurality of magnetic poles and the number of the magnetic poles is five as illustrated in FIG. 2, the configuration of the developing apparatus is not limited to this example. The magnet 42 can include any odd number of magnetic poles so that developer can be peeled off by the repulsive magnetic field between the magnetic poles of the same polarity. Specifically, the present disclosure can be applied also when the number of the magnetic poles is three or seven. If the outer diameter of the developing sleeve 41 is not changed, the distance along the outer peripheral surface of the developing sleeve 41 between the peeling magnetic pole S3 and the scooping magnetic pole S1 tends to decrease as the number of the magnetic poles included in the magnet 42 increases. Specifically, assuming that the developing sleeve 41 has the same outer diameter, when the number of the magnetic poles included in the magnet 42 is five, the dragging phenomenon is more likely to occur than when the number of the magnetic poles included in the magnet 42 is three. Further, assuming that the developing sleeve 41 has a small outer diameter, when the number of the magnetic poles included in the magnet 42 is seven, the dragging phenomenon is more likely to occur than when the number of the magnetic poles included in the magnet 42 is five.

While the above-described exemplary embodiments illustrate an example of the image forming apparatus having the configuration in which the intermediate transfer belt 62 is used as illustrated in FIG. 1, the configuration of the image forming apparatus is not limited to this example. The present disclosure can also be applied to an image forming apparatus having a configuration in which a recording medium is sequentially brought into direct contact with the photosensitive drums 1 (1A, 1B, 1C, 1D) to transfer an image onto the surface of the recording medium.

While the above-described exemplary embodiments illustrate an example of the developing apparatus 4 having the configuration in which the developing sleeve 41 is rotated counterclockwise (in the direction indicated by the arrow in FIG. 2) and the lower blade system is employed as illustrated in FIG. 2, the configuration of the developing apparatus 4 is not limited to this example. The present disclosure can also be applied to the developing apparatus 4 having a configuration in which the developing sleeve 41 is rotated clockwise and the upper blade system is employed.

Figure 3:
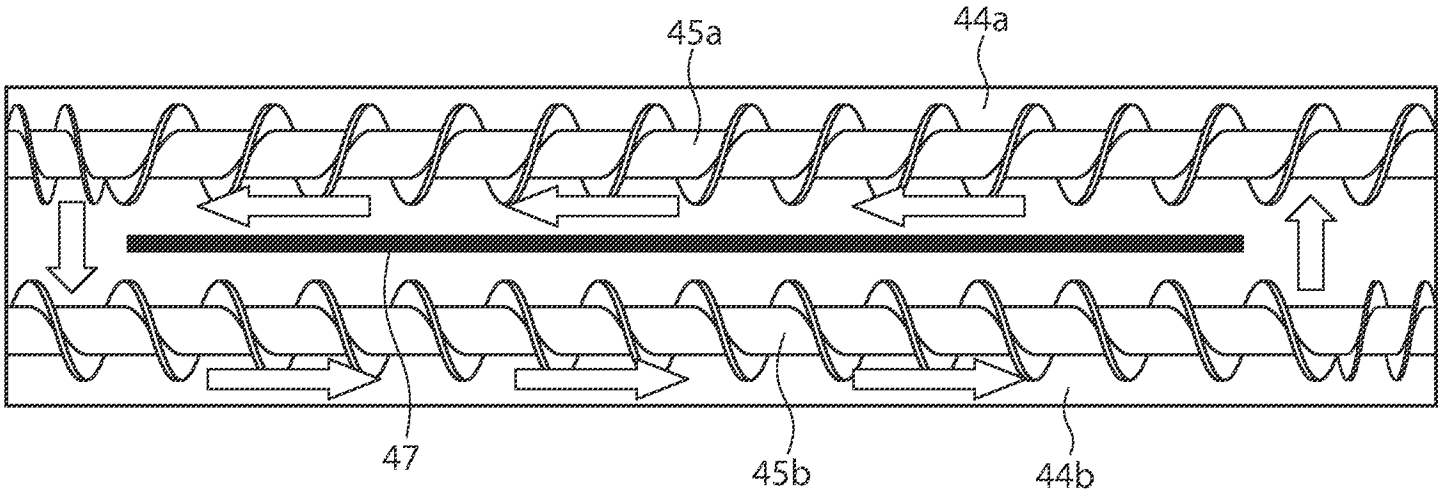
FIG. 3 is a schematic view illustrating a configuration of the developing apparatus according to the first exemplary embodiment.

While the above-described exemplary embodiments illustrate an example of the developing apparatus 4 having the configuration in which the developing chamber 44*a* and the agitating chamber 44*b* are disposed side by side in the horizontal direction as illustrated in FIG. 3, the configuration of the developing apparatus 4 is not limited to this example. The present disclosure can also be applied to the developing apparatus 4 having a configuration in which the developing chamber 44*a* and the agitating chamber 44*b* are arranged one above the other with respect to a gravitational direction.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-142113, filed Aug. 25, 2020, and No. 2021-097957, filed Jun. 11, 2021, which are hereby incorporated by reference herein in their entirety.

What is claimed is:

1. A developing apparatus comprising:

a rotatable developing member configured to carry and feed a developer containing toner and carrier to develop an electrostatic latent image formed on an image carrying member; and a magnet provided non-rotatably and stationarily inside the rotatable developing member and configured to include a first magnetic pole and a second magnetic pole that is provided adjacent to the first magnetic pole at a downstream side of the first magnetic pole with respect to a rotation direction of the rotatable developing member and has the same polarity as the first magnetic pole, wherein a distance along an outer peripheral surface of the rotatable developing member between a first maximum peak position, which corresponds to a maximum value of a magnetic flux density of the first magnetic pole with respect to a normal direction of the rotatable developing member, and a second maximum peak position, which corresponds to a maximum value of a magnetic flux density of the second magnetic pole with respect to the normal direction of the rotatable developing member, is less than 18 [mm], and wherein a distance along the outer peripheral surface of the rotatable developing member in a width of a value obtained by adding 2 [mT] to a minimum value of a magnetic flux density with respect to the normal direction of the rotatable developing member is greater than or equal to 5.5 [mm], at a downstream side of the first maximum peak position and at an upstream side of the second maximum peak position with respect to the rotation direction of the rotatable developing member.

2. The developing apparatus according to claim 1, wherein, in a case where a direction of a force by which a magnetic attraction in the normal direction of the rotatable developing member attracts the developer in a central direction of the rotatable developing member is negative, a distance along the outer peripheral surface of the rotatable developing member in a repulsion width in which the magnetic attraction in the normal direction of the rotatable developing member is a positive value at the downstream side of the first maximum peak position and at the upstream side of the second maximum peak position with respect to the rotation direction of the rotatable developing member is greater than or equal to 4.7 [mm].

3. The developing apparatus according to claim 1, wherein a minimum value of the magnetic flux density with respect to the normal direction of the rotatable developing member at the downstream side of the first maximum peak position and at the upstream side of the second maximum peak position with respect to the rotation direction of the rotatable developing member is in a range from 3 [mT] to 9 [mT].

4. The developing apparatus according to claim 1, wherein an outer diameter of the rotatable developing member is less than or equal to 20 [mm].

5. The developing apparatus according to claim 1, wherein the magnet includes a plurality of magnetic poles, and wherein the number of the magnetic poles is five.

6. The developing apparatus according to claim 1, further comprising a regulating member configured to regulate an amount of developer to be carried on the rotatable developing member, wherein a position where the regulating member is closest to the rotatable developing member when viewed along a section perpendicular to a rotational axis of the rotatable developing member is vertically below a rotation center of the rotatable developing member.

7. The developing apparatus according to claim 1, wherein the outer peripheral surface of the rotatable developing member is provided with a plurality of grooves along a rotational axis direction of the rotatable developing member, wherein the plurality of grooves is formed over an entire area of the outer peripheral surface of the rotatable developing member in the rotation direction of the rotatable developing member, and wherein the grooves are formed at predetermined intervals in the rotation direction of the rotatable developing member.

8. A developing apparatus comprising:

a rotatable developing member configured to carry and feed a developer containing toner and carrier to develop an electrostatic latent image formed on an image carrying member; and a magnet provided non-rotatably and stationarily inside the rotatable developing member and configured to include a first magnetic pole and a second magnetic pole that is provided adjacent to the first magnetic pole at a downstream side of the first magnetic pole with respect to a rotation direction of the rotatable developing member and has the same polarity as the first magnetic pole, wherein a distance along an outer peripheral surface of the rotatable developing member between a first maximum peak position, which corresponds to a maximum value of a magnetic flux density of the first magnetic pole with respect to a normal direction of the rotatable developing member, and a second maximum peak position, which corresponds to a maximum value of a magnetic flux density of the second magnetic pole with respect to the normal direction of the rotatable developing member, is less than 18 [mm], and wherein, in a case where a direction of a force by which a magnetic attraction in the normal direction of the rotatable developing member attracts the developer in a central direction of the rotatable developing member is negative, a distance along the outer peripheral surface of the rotatable developing member in a repulsion width in which the magnetic attraction in the normal direction of the rotatable developing member is a positive value at a downstream side of the first maximum peak position and at an upstream side of the second maximum peak position with respect to the rotation direction of the rotatable developing member is greater than or equal to 4.7 [mm].

9. The developing apparatus according to claim 8, wherein a minimum value of the magnetic flux density with respect to the normal direction of the rotatable developing member at the downstream side of the first maximum peak position and at the upstream side of the second maximum peak position with respect to the rotation direction of the rotatable developing member is in a range from 3 [mT] to 9 [mT].

10. The developing apparatus according to claim 8, wherein an outer diameter of the rotatable developing member is less than or equal to 20 [mm].

11. The developing apparatus according to claim 8, wherein the magnet includes a plurality of magnetic poles, and wherein the number of the magnetic poles is five.

12. The developing apparatus according to claim 8, further comprising a regulating member configured to regulate an amount of developer to be carried on the rotatable developing member, wherein a position where the regulating member is closest to the rotatable developing member when viewed along a section perpendicular to a rotational axis of the rotatable developing member is vertically below a rotation center of the rotatable developing member.

13. The developing apparatus according to claim 8, wherein the outer peripheral surface of the rotatable developing member is provided with a plurality of grooves along a rotational axis direction of the rotatable developing member, wherein the plurality of grooves is formed over an entire area of the outer peripheral surface of the rotatable developing member in the rotation direction of the rotatable developing member, and wherein the grooves are formed at predetermined intervals in the rotation direction of the rotatable developing member.

* * * * *